US005990601A

United States Patent [19]

Orthuber et al.

[11] Patent Number: 5,990,601

[45] Date of Patent: Nov. 23, 1999

[54] ELECTRON MULTIPLIER AND METHODS AND APPARATUS FOR PROCESSING THE SAME

[75] Inventors: Richard Kaspar Orthuber, Sepulveda; Philip George Reif, Chatsworth, both of Calif.

[73] Assignee: ITT Manufacturing Enterprises, Inc., Wilmington, Del.

[21] Appl. No.: 05/117,698

[22] Filed: Feb. 22, 1971

[51] Int. Cl.[6] ..... H01J 43/00

[52] U.S. Cl. ..... 313/105 CM; 313/103 CM; 313/534

[58] Field of Search ..... 313/103, 104, 313/105, 106, 107, 68 R, 68 A, 534, 103 CM, 105 CM; 250/207, 213; 315/11, 12

[56] References Cited

U.S. PATENT DOCUMENTS

| | | | |
|---|---|---|---|
| 2,537,923 | 1/1951 | Van Overbeek | 313/104 X |
| 2,773,992 | 12/1956 | Ullery | 250/213 R |
| 3,201,630 | 8/1965 | Orthuber et al. | 313/106 |
| 3,244,922 | 4/1966 | Wolfgang | 313/103 |
| 3,424,909 | 1/1969 | Rougeot | 250/207 |
| 3,449,582 | 6/1969 | Sackinger | 313/105 |
| 3,634,712 | 1/1972 | Orthuber | 313/103 |

*Primary Examiner*—Peter A. Nelson

[57] ABSTRACT

A channel-type electron multiplier and a method and apparatus for rounding off the sharp circular edges, fissures and protrusions at the ends of the holes in the glass plate. In order to do this a temperature gradient is produced through the plate so that only a small portion is heated above the glass softening temperature. The plate thus does not collapse or melt. The said rounded edges improve performance by reducing field emission, noise and photocathode contamination. An electrically heated nichrome wire provides heat pulses at regular intervals. An alternative method utilizes an optical lap after core glass in the plate holes has been partially etched out.

2 Claims, 1 Drawing Sheet

ELECTRON MULTIPLIER AND METHODS AND APPARATUS FOR PROCESSING THE SAME

BACKGROUND OF THE INVENTION

This invention relates to electron multipliers, and more particularly, to an improved multiplier and methods and apparatus for rounding off the sharp circular edges, fissures and protrusions at the ends of the holes in the dielectric plate of a channel-type electron multiplier.

In the prior art, it has been the practice to construct an electron multiplier of a glass plate which is more or less solid except for cylindrical holes having parallel axes, the holes extending completely through the plate. For example, see U.S. Pat. No. 3,449,582. When the plate, sometimes called a microchannel plate (MCP), is hydrogen fired, the hole surfaces become secondary emissive. However, the plate usually has two conductive faces which lie in two parallel planes, respectively, both plates lying, in turn, perpendicular to or lying a few degrees from ninety from the axes of the holes. Thus a cylinder of a hole diameter and located concentric with the axis of a hole intersects both of said planes on an approximately circular line where sharp, approximately circular edges exist. These sharp edges then exist at each end of each hole. Fissures and protrusions also exist at and near these sharp edges.

In accordance with the present invention, it has been discovered that the existence of the said sharp circular edges and the fissures and protrusions have several very serious disadvantages.

In the first place, the sharp edges and protrusions create enormous electric field intensities which causes field emission. The electron field emission on the input ends of the holes then acts as a source of undesired primary electrons which are multiplied just the same as the desired primary electrons. The undesired primaries and the undesired secondaries which are generated as a result of the undesired primaries then add substantially to the tube noise.

Still further, it is common to use a photocathode as a source of desired primary electrons. In such a case, with the very high electric field intensities created by the said sharp edges, desorption of positive ions adsorbed by the plate can take place. Since the photocathode is conventionally maintained at a potential negative with respect to the plate, some, if not all, of the desorbed positive ions will invariably bombard the photocathode and contaminate it, i.e. eventually cause its efficiency to be reduced so much that its useful life is considerably shortened.

SUMMARY OF THE INVENTION

In accordance with the present invention, the above-described and other disadvantages of the prior art are overcome by providing rounded off edges at the ends of the plate holes.

In accordance with one feature of the invention, this is done by producing a temperature gradient through the plate and heating only one surface thereof to the dielectric softening temperature. Heat pulsing may also be used to advantage to keep the plate from melting or collapsing.

A feature of the invention resides in the use of a wire heated electrically to provide heat pulses to a plate moving under the wire, or vice versa. That is, the vertical orientation of the wire may be above or below the plate. Further, either the plate or the wire may be moved, or both.

A still further feature of the invention resides in polishing a plate after core glass filling the plate holes has been partially etched out.

The above-described and other advantages of the present invention will be better understood from the following detailed description when considered in connection with the accompanying drawings.

BRIEF DESCRIPTION OF THE DRAWINGS

In the drawings, which are to be regarded as merely illustrative.

DESCRIPTION OF THE PREFERRED EMBODIMENT

In FIGS. 1, 2, 3, 4, 5 and 6 steps in a conventional method of making an electron multiplier are indicated.

Figure 1:
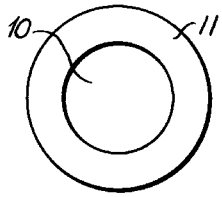
FIG. 1 is an end elevational view of a glass rod and a concentric glass tube.
Figure 2:
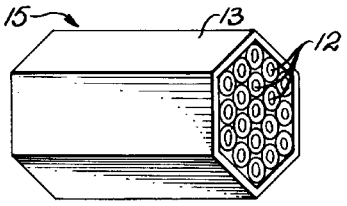
FIG. 2 is a perspective view of a carbon hexagon mold packed with glass rods and glass tubes concentric therewith.
Figure 4:
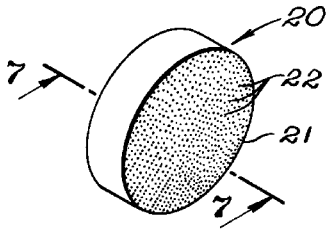
FIG. 4 is a perspective view of a glass wafer cut from the boule of FIG. 3.

In FIG. 1, glass rod stock 10 and glass tube stock 11 are heated and drawn together down to a rather small fiber size and cut into, for example, four or six inch lengths. The fibers at 12 in FIG. 2 are then packed between the upper and lower halves 13 and 14 of a carbon mold 15. Fibers 12 are heated in mold 15 to fuse or lightly tack them together.

Figure 3:
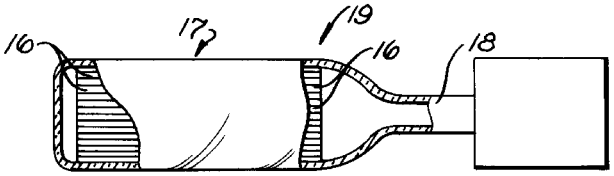
FIG. 3 is a side elevational view of a glass boule and evacuation apparatus therefor.
Figure 5:
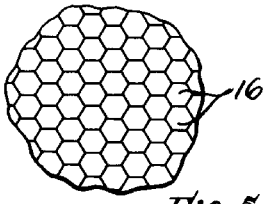
FIG. 5 is an enlarged view of a portion of one circular surface of the wafer illustrating a hexagon pattern.

The hexagon bundle of fibers 12 is then conventionally heated drawn down to a substantially smaller fiber such as a fiber 16, shown in FIG. 3 and FIG. 5. The fibers 16 are then packed neatly together in a glass tube 17 in Fig. 3 so that they look like they do in FIG. 5 in end elevation.

Tube 17 is then heated to collapse end portion 18. Tube 17 is then heated and evacuated by apparatus 18, and then allowed to cool. After cooling, the fiber filled tube 17 is called a boule. The boule is indicated at 19.

The boule 19 has an approximately cylindrical outer surface with a corresponding axis of symmetry. The boule 19 is then sliced a number of times perpendicular to the said axis to form wafers. One such wafer is indicated at 20 in FIG. 4. Portions of the glass tube stock 11 have fused together to form a substantially solid plate 21 with cores 22 extending therethrough. Cores 22 are thus made of the glass of rod stock 10.

It is often advantageous to cut the wafers a few degrees such as seven degrees off the perpendicular, and this may be done in accordance with the present invention, if desired.

Before wafer 20 is sliced, the pack of fibers 16 may be ground to a cylindrical shape, if desired. In this case, tube 17 is ground off of the pack. Thus, wafer 20 may be a perfect right cylinder, mathematically speaking, with a cylindrical peripheral surface perpendicular to each of two parallel circular end surfaces.

Figure 6:
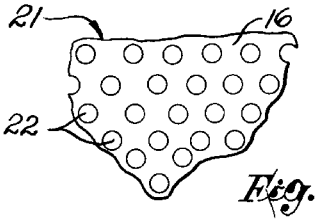
FIG. 6 is a view of the wafer surface enlarged beyond that of FIG. 5.

FIG. 5 is an enlarged view of a portion of one circular end surface of wafer 20. FIG. 6 is an enlarged view of the same end surface of a fiber 16 that is shown in FIG. 5.

The wafer 20 may be sliced from boule 19 in the conventional way with a conventional diamond band saw or by any other conventional method or apparatus. Each said circular end surface of wafer 20 is then polished by subjecting it to a conventional optical lap by the use of a conventional carborundum wheel or other conventional apparatus.

The glass of rod stock 10 is different from that of tube stock 11. Thus, after polishing, cores 22 are etched out with hydrochloric acid. The wafer 20, before or after etching, may be called a microchannel plate (MCP).

The existing procedure of slicing and polishing the surfaces of MCP's cannot be considered ideal from a standpoint of minimizing field emission from the entrance and exit apertures of individual channels in an operating MCP. Particularly, field emission electrons released near the input surface may lead to serious degradation of the MCP noise figure, since such electrons will subsequently be multiplied just as signal electrons.

The sharp edge surrounding the entrance aperture and the unavoidable presence of microscopic and submicroscopic fissures and protrusions after slicing and grinding may not be totally or even partially modified by subsequent polishing. This is true because polishing the inside of the channel ends is prevented by the cores within the channels. In other words, the cores are in the way. Besides, it must be considered that according to the accepted flow theory* of the polishing process (Beilby) smoothing by mechanical polishing consists, in essence, in a transport of material to fill out minute cracks and fissures. Unfortunately, however, those cracks are restored in subsequent etching processes (Holland, l.c.p. 50) and, for this reason, it appears highly probable that MCP's prepared according to present procedures do not possess a geometry free of cavities and fissures on a submicroscopic scale.

*L. Holland, The Properties of Glass Surfaces, p. 28 tt.

Figure 7:
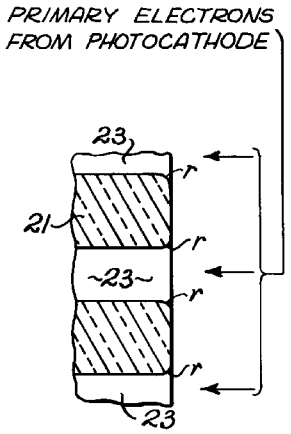
FIG. 7 is a transverse sectional view of a portion of the wafer taken on the line 7—7, shown in FIG. 4.

Even neglecting submicroscopic surface irregularities, the geometry of the input (and output) surfaces with present MCP preparation techniques yields the geometry shown in FIG. 7. Plate 21 has holes 23 therethrough where cores 22 were etched out.

Though the field in front of the MCP (towards the photocathode—see the said patent) is relatively modest (about 500 volts/mm.), the local field strength acting on a small spherical surface of 0.2 micron radius would, due to the strong curvature, assume the very high value of $$\frac{100 \text{ volts}}{.2 \text{ micron}} = 5 \times 10^6$$

volts/cm. Note that radius, r, in FIG. 7 may typically be equal to 0.2 micron. For the annular shaped aperture regions of an MCP, a similar though somewhat lower field enhancement must be expected.

The radius of curvature of about 0.2 micron or less is estimated for MCP's processed according to prior art procedures. Local fields of this order came uncomfortably close to the magnitude where field induced emission of electrons becomes significant. Such spontaneous emission of electrons is actually observed frequently in operating microchannel intensifiers and is a major cause for rejects.

In addition, it is known (Encyclopedia of Physics, Vol. XXI, p. 219) that very high localized fields can lead to the desorption of adsorbed ions, particularly alkali ions. Since a slight alkali metal coverage on the input surface of an MCP in a sealed off intensifier tube is virtually unavoidable, it can be concluded that the sharp curvature of the channel apertures causing high fields is contributory to the frequently observed photocathode contamination occurring during operation of a microchannel intensifier.

In accordance with the present invention, it has been found highly desirable to modify the MCP processing so that:

(1) The radius of curvature at the channel entrance is considerably enlarged.

(2) That this area is smoothed on a submicroscopic scale, eliminating cracks and protrusions which produce excessive fields on the entrance surface.

Figure 8:
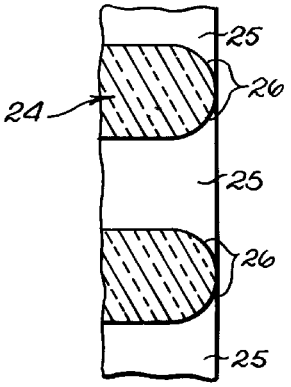
FIG. 8 is a section similar to FIG. 7 illustrating the multiplier structure of the present invention.

One embodiment of the MCP of the present invention is shown in FIG. 8. A glass plate 24 has channels 25 with rounded off edges 26. With plates of the presently prevalent channel-to-channel spacing, the wall thickness is 2–4 microns and, thus, with cylindrical surfaces defining the apertures, a radius of curvature of 1 to 2 microns would be feasible—5 to 10 times larger than presently available. Consequently, this would reduce the local field strength by 5 or 10 times.

The following methods achieve this construction:

(1) Polishing the MCP After Partial Etching.

This method involves etching out only a portion of the core at one end thereof. The MCP is then polished by subjecting it to an optical lap only after the said core portion has been removed and before the core has been completely removed. The total length of a channel is usually much longer than five channel diameters. The core may be etched out of a depth of one to five channel diameters from one core end. The rest of the core is removed after polishing. This leads to a rounding of the sharp edges of radius, r, shown in FIG. 7, and now prevalent. Experiments have shown that this leads to a decrease of curvature. Partial removal or etching of the core gives the MCP structural strength needed to undergo the optical lap.

Fire-polishing solely by a continuous airbake near the softening point of 8161 glass was attempted before the present invention. These attempts failed because bake temperatures sufficient to allow viscous flow at the surface would, at the same time, induce an intolerable deformation of the basic MCP structure. In accordance with the present invention, a fire-polishing process, affecting the MCP surface without, at the same time, ruining the bulk geometry of the plate, was discovered which provides differential heating, i.e. the capability of heating the surface layer to a significantly higher temperature than the MCP bulk. The following two fire-polishing methods may be employed for this purpose .

(2) Continuous Heatflow Technique.

One way of differential heating comprises establishing a continuous heat flow through the MCP between the said two circular surfaces such that one surface is maintained well below softening temperature (but which may be above ambient) while the other surface is intensively heated, e.g. by radiation impinging on the surface to be polished to a temperature above the softening point. The temperature gradient thus established will then make it possible to establish a plane between the surfaces, and parallel to them, which separates a domain of viscous flow and, therefore, rounding and smoothing by tension from a rigid domain, the MCP bulk, where structural integrity is maintained.

(3) Pulse-Heating.

An alternate approach to the surface fire-polishing of MCP's is a technique akin to electron beam and laser beam machining. This approach utilizes the fact that a heat conducting slab heated intermittently with low duty cycle on one surface, but kept at ambient temperature on the other side can on the heated side undergo drastic temperature rises while maintaining in its interior a nearly constant low temperature.

This technique appears well applicable to the desired surface shaping of MCP's in accordance with the invention without incurring the danger of disturbing the geometry of the channels proper. A simple arrangement to carry out this procedure, without need of lasers or electron beam machining equipment, is schematically shown in FIGS. 9 and 10.

Figure 9:
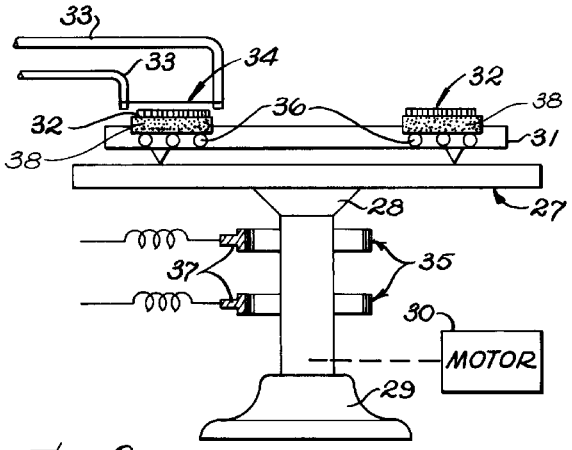
FIG. 9 is a vertical sectional view of one embodiment of the apparatus of the invention.

In FIG. 9, a turntable 27 is rotatably mounted on a vertical shaft 28 which is rotatable in a base 29. A motor 30 rotates shaft 28 at a constant speed.

Turntable 27 carries a calrod support 31. Support 31 carries graphite MCP holders 38. MCP's with cores 22 removed are indicated at 32. Conductors and supports 33 hold a heating wire 34 over MCP's 32. Slip rings 35 provide means to supply electric current to a heating coil 36 in support 31. Slip rings 35 have brushes 37 in engagement therewith.

Figure 10:
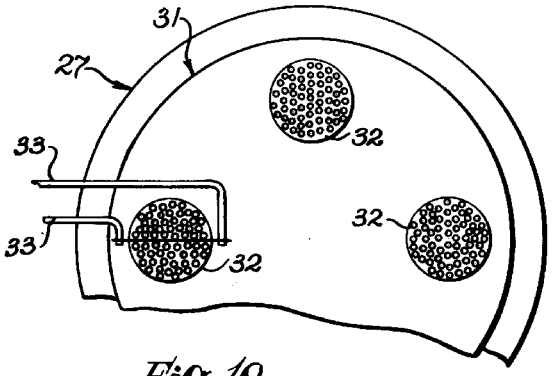
FIG. 10 is a broken away top plan view of the apparatus shown in FIG. 9.

The apparatus of FIGS. 9 and 10 comprises support 31 which is a heated support mounted on the turntable 27. Support 31 carries a number of MCP holders 38. The purpose of this rotating bias heater is to establish an MCP temperature slightly under the softening point of 8161 glass (~600° C.). The heating wire 34, nichrome for instance, is arranged closely above the support 31, so that MCP's mounted thereon in rotating, pass closely under the hot wire 34. The wire 34 is heated to a temperature of e.g. 1,500° C., well above the 8161 softening point. Thus, any point on the MCP surface receives a short but intensive heat pulse on each pass under the hot wire. During this pulse, with properly adjusted speed of rotation, the glass will be softened enough to yield to surface tension and will by repeated passes under the hot wire 34 step by step produce the rounded and extremely smooth configuration characteristic for polished surfaces. The bulk temperature will, during the entire operation, stay below the softening point so that the MCP bulk remains undeformed.

If desired, the apparatus of FIGS. 9 and 10 may be supplied with retaining clips and brackets to allow inverted mounting of the MCP's 32 with the heating wire 34 underneath 32, which will cause gravity flow of the softened glass away from the bulk and, thus, prevent narrowing the holes. However, the apparatus of FIGS. 9 and 10 may also work very well upright as shown therein for the following reasons.

The shaping of the MCP surface, particularly the edges around the channel apertures, happens under the influence of surface tension just as, e.g. the shaping of a drop of mercury. Surface tension tends to minimize the surface area even with a solid, but only after the resistance to material flow or the viscosity is decreased by sufficiently heating the material. After heating, the material then flows into a minimum surface energy configuration which abhors sharp edges. The final form will not necessarily be perfectly hemispherical, but it will be such that the said prior art circular sharp edges and protrusions have vanished.

What is claimed is:

1. An electron multiplier comprising: a vacuum tube having a faceplate at one end, a photocathode on the inner surface of said faceplate, a dielectric plate spaced from said photocathode within said tube and having opposite faces and a plurality of parallel holes extending completely therethrough between said faces, one of said faces being disposed to receive electrons from said photocathode, the length of said holes being greater than five times the diameter thereof, said holes on said one face having rounded edges widening outwardly toward said face around the entire periphery of each hole, each said edge having a radius of curvature of from 1 to 2 microns to reduce field emission, and means applying operating voltages to said photocathode and opposite faces of said dielectric plate.

2. The invention as defined in claim 1, wherein said edges have a radius of curvature greater than 1.0 micron and less than half the wall thickness between adjacent holes, said wall thickness being in a range of approximately from 2 to 4 microns.

* * * * *